US010214314B2

(12) United States Patent
Claxton

(10) Patent No.: US 10,214,314 B2
(45) Date of Patent: Feb. 26, 2019

(54) CONTAINERS HAVING CRUMPLE ZONES AND RELATED METHODS

(71) Applicant: INTEPLAST GROUP CORPORATION, Livingston, NJ (US)

(72) Inventor: Christopher L. Claxton, Bay City, TX (US)

(73) Assignee: Inteplast Group Corporation, Livingston, NJ (US)

( * ) Notice: Subject to any disclaimer, the term of this patent is extended or adjusted under 35 U.S.C. 154(b) by 7 days.

(21) Appl. No.: 15/365,501

(22) Filed: Nov. 30, 2016

(65) Prior Publication Data

US 2018/0148217 A1 May 31, 2018

(51) Int. Cl.
*B65D 5/42* (2006.01)

(52) U.S. Cl.
CPC ..... *B65D 5/4266* (2013.01); *B65D 5/42* (2013.01)

(58) Field of Classification Search
CPC .. B65D 5/3621; B65D 5/3628; B65D 5/4266; B65D 5/02; B65D 5/3678
USPC ... 229/5.5, 5.6, 117.01, 101, 117.05, 117.06, 229/103, 117, 117.03, 920; 206/216; 493/185, 311
See application file for complete search history.

(56) References Cited

U.S. PATENT DOCUMENTS 2,732,995 A 9/1949 Geisler
2,791,367 A * 5/1957 Mefford ..... B65D 5/0005 206/216
2,857,090 A 10/1958 Fallert
3,294,308 A 12/1966 Tress et al.
4,221,294 A 9/1980 Burgess
5,062,527 A 11/1991 Westerman
5,294,043 A 3/1994 Platt
5,975,411 A * 11/1999 Windolph, III ..... B65D 5/0005 229/101
6,102,280 A 8/2000 Dowd
7,128,257 B2 * 10/2006 Hyatt ..... B65D 5/029 229/183
7,721,941 B2 5/2010 Kleiner
7,841,512 B2 11/2010 Westerman et al.
8,348,819 B1 * 1/2013 Costanzo, Jr. ..... B65D 5/241 493/126
8,348,820 B2 1/2013 Costanzo, Jr. et al.
8,474,686 B2 7/2013 Glaser et al.
8,814,034 B2 * 8/2014 Dickie ..... B65D 5/746 206/459.5

* cited by examiner

*Primary Examiner* — Christopher Demeree
(74) *Attorney, Agent, or Firm* — Matthew D. Thayne; Thayne and Davis LLC

(57) ABSTRACT

Containers having weakened regions in one or more corners to prevent or inhibit container damage and related methods. In some embodiments, the container may comprise a bottom wall and one or more bottom wall corners defined in part by the bottom wall. Weakened regions or crumple zones may be positioned about one or more such corners. In some embodiments, the weakened region(s) may comprise weakened line(s) circumscribing the bottom wall corner(s) that may be configured to deform and absorb drop forces resulting from the container being dropped to reduce the possibility of the drop forces tearing the container.

20 Claims, 3 Drawing Sheets

CONTAINERS HAVING CRUMPLE ZONES AND RELATED METHODS

SUMMARY

Embodiments of sheets, such as foldable, plastic sheets having weakened regions or crumple zones for preventing or inhibiting container damage are disclosed herein, along with implementations of related methods. Finished containers are also disclosed herein. In some embodiments, such sheets/containers may be configured to deform along one or more corners of the containers and absorb drop forces resulting from the container being dropped to reduce the possibility of the drop forces tearing the container.

In a specific example of a sheet for folding into a container according to some embodiments, the sheet may comprise a first side panel, a second side panel positioned adjacent to the first side panel, and a third side panel positioned adjacent to the first side panel opposite from the second side panel. The sheet may further comprise a first bottom panel positioned adjacent to the first side panel and configured to be folded with respect to the first side panel during a folding process for folding the sheet into a three-dimensional container so as to at least partially define a bottom wall of the container. A first fold line may extend between the first side panel and the first bottom panel. A first plurality of weakened lines—such as fold lines, creases, spaced cuts, tear seams, stamped regions, or the like—may be positioned on the first side panel and may extend at an acute angle between the first fold line and the second side panel. A second plurality of weakened lines may be positioned on the first side panel opposite from the first plurality of weakened lines and may also extend at an acute angle between the first fold line and the third side panel. A third plurality of weakened lines may be positioned on the first bottom panel and may extend at an acute angle between the first fold line and a first peripheral edge of the first bottom panel. And a fourth plurality of weakened lines may be positioned on the first bottom panel opposite from the third plurality of weakened lines and may extend at an acute angle between the first fold line and a second peripheral edge of the first bottom panel opposite from the first peripheral edge.

Some embodiments may further comprise a second bottom panel positioned adjacent to the second side panel and a third bottom panel positioned adjacent to the third side panel. A second fold line may extend between the second side panel and the second bottom panel and a third fold line may extend between the third side panel and the third bottom panel. Additional weakened lines may be provided. For example, a fifth plurality of weakened lines may be positioned on the second side panel and may extend at an acute angle between the second fold line and the first side panel; a sixth plurality of weakened lines may be positioned on the second bottom panel and may extend at an acute angle between the second fold line and the first peripheral edge; a seventh plurality of weakened lines may be positioned on the third side panel and may extend at an acute angle between the third fold line and the first side panel; and an eighth plurality of weakened lines may be positioned on the third bottom panel and may extend between the third fold line and the second peripheral edge.

In some embodiments, the first plurality of weakened lines at least substantially aligns with the fifth plurality of weakened lines, the fifth plurality of weakened lines at least substantially aligns with the sixth plurality of weakened lines, the sixth plurality of weakened lines at least substantially aligns with the third plurality of weakened lines, and the third plurality of weakened lines at least substantially aligns with the first plurality of weakened lines.

In some embodiments, the first, third, fifth, and sixth plurality of weakened lines circumscribe a corner of the sheet defined by the first side panel, the second side panel, the first bottom panel, and the second bottom panel. In some such embodiments, each of the various bottom and/or top corners of the sheets may be circumscribed by weakened lines. In some embodiments, the first, third, fifth, and sixth plurality of weakened lines together define a rectangular shape, such as a square in some embodiments, circumscribing the corner of the sheet.

In an example of a container according to some embodiments, the container may comprise a bottom wall and a plurality of side walls. Each of the plurality of side walls may be positioned adjacent to the bottom wall so as to define four bottom corners. One or more of the four bottom corners may comprise a weakened region configured to deform and absorb drop forces resulting from the container being dropped to reduce the possibility of the drop forces tearing the container. In some embodiments, the plurality of weakened lines may at least substantially circumscribe the at least one of the four bottom corners along the bottom wall and along two adjacent side walls.

In some embodiments, the weakened lines may be positioned to extend parallel, or at least substantially parallel, to each other. In some such embodiments, the weakened lines may be spaced apart from each other by a distance of between about 0.5 inches and about 0.8 inches.

The weakened lines may extend from adjacent edges of one or more of the four bottom corners at acute angles ranging from between about 25 degrees and about 65 degrees. In some such embodiments, the weakened lines may extend from adjacent edges of the at least one of the four bottom corners at an angle of about 45 degrees.

In some embodiments, one or more of the top corners of the container may also comprise a weakened region. Thus, some embodiments may comprise a top wall, wherein each of the plurality of side walls is positioned adjacent to the top wall so as to define four top corners, wherein each of the four top corners comprises a weakened region comprising a plurality of weakened lines circumscribing the at least one of the four top corners along the top wall and along two adjacent side walls, and wherein each of the weakened regions is configured to deform and absorb drop forces resulting from the container being dropped to reduce the possibility of the drop forces tearing the container.

In another example of a container according to other embodiments, the container may comprise a bottom wall, a first bottom wall corner defined in part by the bottom wall, and a first weakened line circumscribing the first bottom wall corner. The first weakened line may be configured to deform and absorb drop forces resulting from the container being dropped to reduce the possibility of the drop forces tearing the container.

Some embodiments may further comprise a second bottom wall corner defined in part by the bottom wall, a second weakened line circumscribing the second bottom wall corner, a third bottom wall corner defined in part by the bottom wall, a third weakened line circumscribing the third bottom wall corner, a fourth bottom wall corner defined in part by the bottom wall, and a fourth weakened line circumscribing the fourth bottom wall corner, such that each of the various bottom corners comprises a weakened region.

Some embodiments may further comprise a second weakened line circumscribing the first bottom wall corner. In some such embodiments, the second weakened line may be at least substantially parallel to the first weakened line. In some such embodiments, the second weakened line may be spaced from the first weakened line by a distance of between about 0.5 inches and about 0.8 inches.

In some embodiments, the first weakened line may extend from adjacent edges of the first bottom wall corner at an acute angle ranging from between about 25 degrees and about 65 degrees.

The features, structures, steps, or characteristics disclosed herein in connection with one embodiment may be combined in any suitable manner in one or more alternative embodiments.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

Consistent with embodiments disclosed herein, foldable containers, such as reusable containers, may be utilized to store produce, along with foldable sheets for creating such containers. In some embodiments, such containers may comprise corrugated plastic containers.

Preferably, the containers are formed with "crumple zones" at one or more corners of the container so as to absorb forces, such as forces associated with dropping the container, so as to prevent or at least inhibit splitting/tearing along the corners that might allow for the contents of the container to spill out and/or might otherwise undesirably damage the container. Thus, in some embodiments, such containers may be configured with crumple zones that are defined by weakened lines. Such weakened lines may be formed, for example, by forming creases, spaced cuts, tear seams, stamped regions, or the like. In certain preferred embodiments, such weakened lines may be formed so as to circumscribe, or at least substantially circumscribe, the corner(s) of the container. Various additional features and benefits may be provided in connection with particular embodiments, as discussed in detail below.

Figure 1:
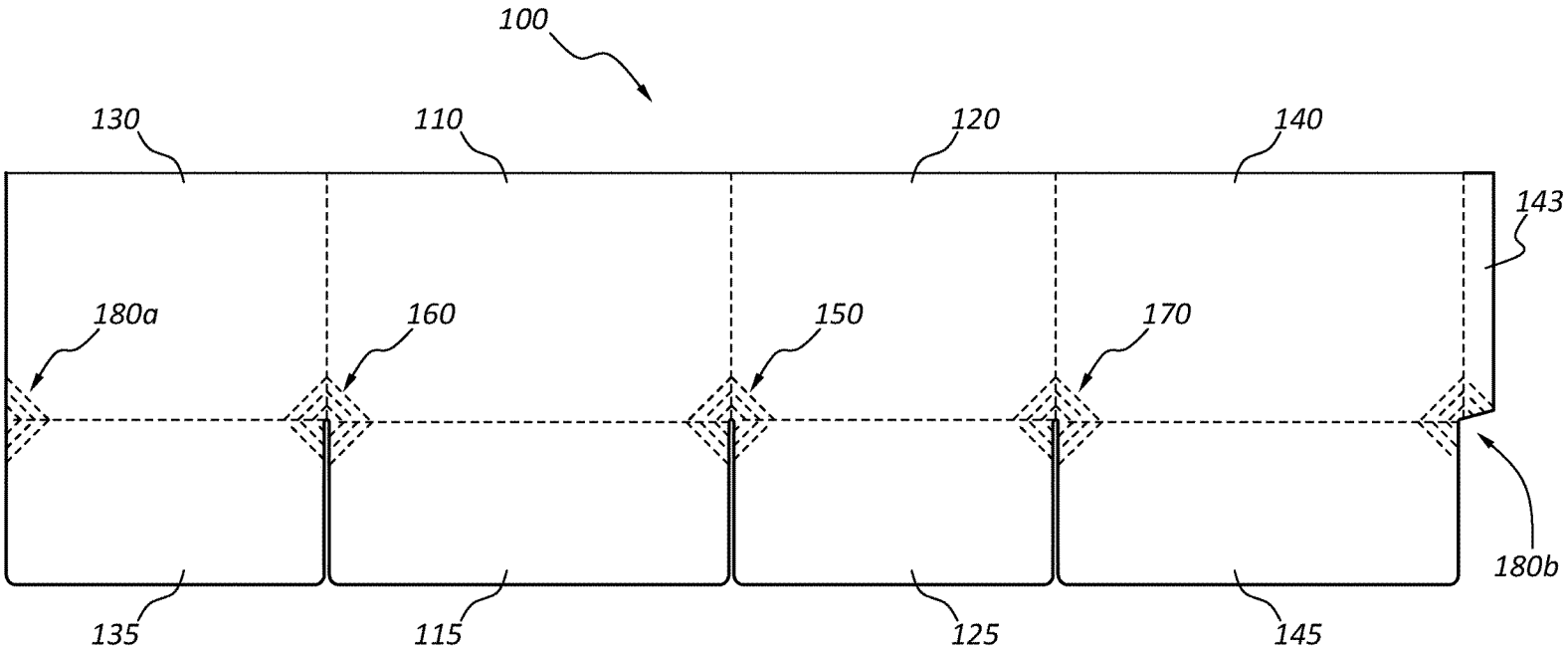
FIG. 1 is a top plan view of a sheet configured for folding into a container consistent with some embodiments.

FIG. 1 illustrates a sheet 100 consistent with embodiments of the present disclosure. Sheet 100 comprises a substantially planar sheet that may be folded into a three-dimensional container. In some embodiments, sheet 100 may comprise a plastic. In some such embodiments, sheet 100 may comprise a corrugated plastic, such as a plastic made up of corrugated flutes.

Sheet 100 comprises a plurality of panels configured to be folded with respect to one another during a folding/assembly process. More particularly, sheet 100 comprises a first panel 110 that, when folded/assembled, will define a side wall to a container and may therefore be referred to herein as a "side panel." Similarly, sheet 100 comprises a second panel 120 configured to serve as an adjacent side wall of the container, a third panel 130 configured to serve as another side wall of the container, and a fourth panel 140 configured to serve as another side wall of the container.

Sheet 100 further comprises additional panels 115, 125, 135, and 145, each of which is configured to define a portion of a bottom wall of the container and therefore may be referred to herein as "bottom panels." In the depicted embodiment, some of the bottom panels may be configured to overlap with one another. Other panels, bottom or otherwise, may be configured to extend adjacent to one another in the same plane without overlapping. Although not present in the embodiment of FIG. 1, it should be understood that alternative embodiments are contemplated in which one or more panels may also be provided that define a lid or top wall of the container. Such panels therefore may be referred to herein as "top panels."

Various fold lines may be positioned to extend between the adjacent panels. For example, with respect to side panel 110, a fold line extends between side panel 110 and adjacent side panel 120. Similarly, another fold line extends between side panel 110 and bottom panel 115.

In addition, each of the corner regions between adjacent side and bottom panels comprises a weakened region or crumple zone defined by a plurality of weakened lines. Each of these weakened regions is preferably configured to deform and absorb drop forces resulting from the container being dropped to reduce the possibility of the drop forces tearing the resulting container.

More particularly, weakened region 150 is positioned at the corner between side panels 110 and 120, and bottom panels 115 and 125. Similarly, weakened region 160 is positioned at the corner between side panels 110 and 130, and bottom panels 115 and 135, and weakened region 170 is positioned at the corner between side panels 120 and 140, and bottom panels 125 and 145. An additional weakened region 180 is partially defined at opposite ends of sheet 100. More particularly, partial weakened region **180*a* is defined between side panel 130 and bottom panel 135, and partial weakened region 180*b* is defined between side panel 140 and bottom panel 145. In some embodiments, part of the weakened region 180 may be formed on a flap, such as flap 143, that is configured to facilitate coupling between opposite ends of sheet 100, as shown in FIG. 1**.

The weakened lines defining each of the various weakened regions may comprise creases or fold lines, which may be similar or identical to the fold lines between adjacent panels referenced above. Alternatively, such weakened lines may comprise other suitable features, such as spaced cuts, tear seams, stamped regions, or the like. As depicted in FIG. 1, the weakened lines may be positioned in a plurality of adjacent lines that may, in some embodiments, extend parallel, or at least substantially parallel, to one another. Such lines may, in some embodiments, circumscribe each corner of the sheet that comprises a weakened region. In the depicted embodiment, these parallel lines define a rectangular (in some such embodiments, square) shape circumscribing the corners of the sheet that will ultimately define the bottom corners of the resulting container. However, as will be more readily apparent in connection with the discussion of FIG. 2 below, some embodiments may instead be configured with less than four sets of weakened lines so as to define, for example, a triangular shape circumscribing the corner(s).

Each weakened region in the embodiment of FIG. 1 comprises three weakened lines that circumscribe each of the various bottom corners. In addition, each of these weakened lines extends at an acute angle between the adjacent fold lines. Thus, with respect to weakened region 150, each of the weakened lines extends at an acute angle between the fold line between panels 110 and 115 and the fold line between panels 110 and 120, and so on around the corner corresponding with weakened region 150.

Figure 2:
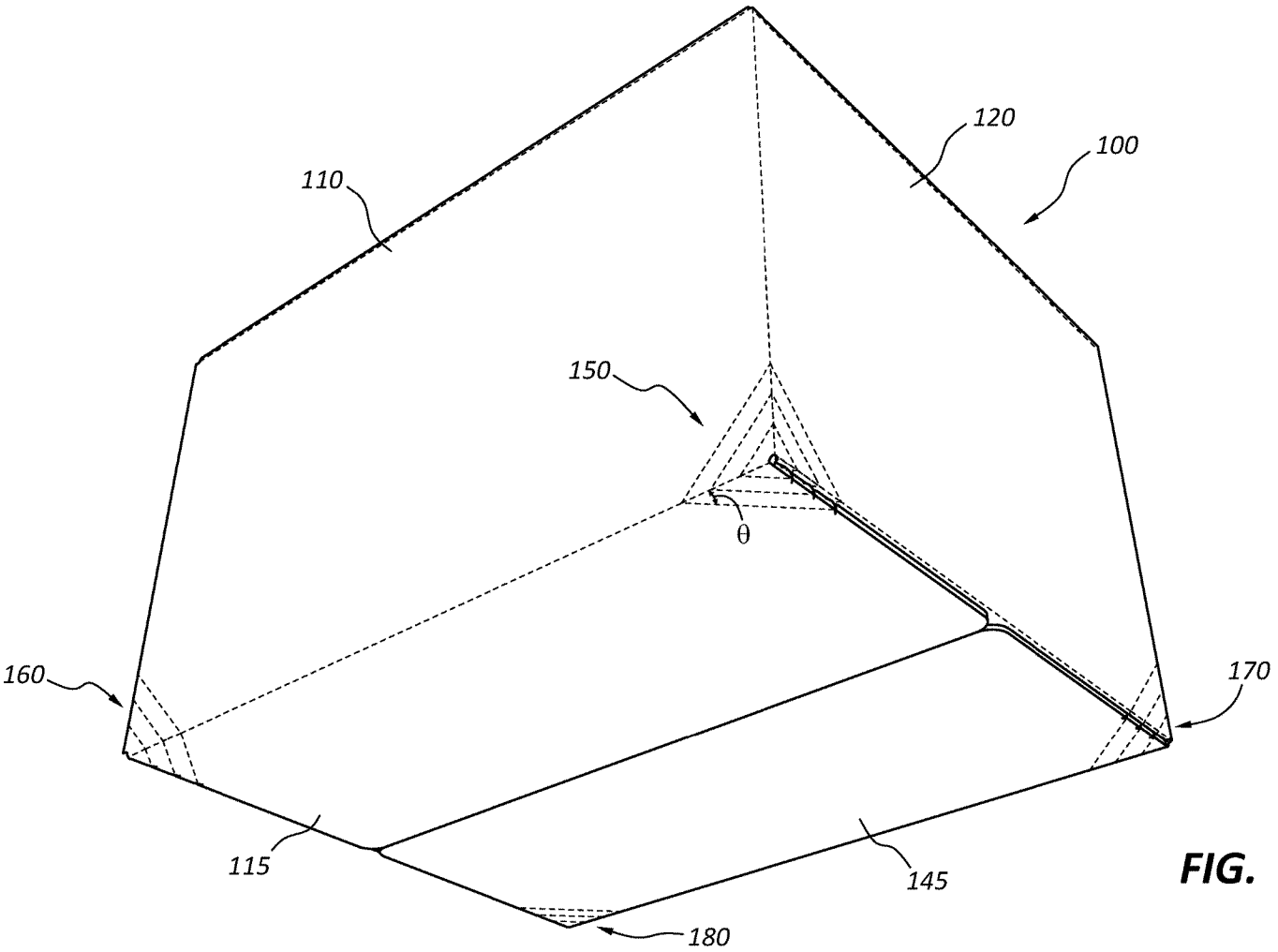
FIG. 2 is a perspective view of a container resulting from folding the sheet of FIG. 1.

In some embodiments, the weakened lines extending along one panel may be positioned to align, or at least substantially align, with the weakened lines on one or more adjacent panels so that, as shown in FIG. 2—which depicts a completed container folded from the sheet 100 of FIG. 1—the fold/weakened lines extend in a continuous, or at least substantially continuous, pattern about the corners of the container 100.

As also depicted in FIG. 2, the weakened lines extend from adjacent edges of container 100 at an angle θ, which, as mentioned above, preferably comprises an acute angle. In preferred embodiments, this acute angle may be between about 25 degrees and about 65 degrees. In some such embodiments, the acute angle may be about 45 degrees. In the embodiment of FIG. 2, angle θ is the same along each panel of each corner of the container 100. However, alternative embodiments are contemplated in which this angle need not be identical and may instead vary from one panel to another and/or from one corner to another, as needed or desired in accordance with the particular type of container and/or application.

In embodiments comprising a plurality of spaced apart weakened lines, such lines may be spaced apart from each other by a distance of between about 0.5 inches and about 0.8 inches. However, various alternative embodiments are contemplated. For example, various alternative numbers and/or configurations of weakened lines or other weakening configurations may be used. For example, various different spacings of weakened lines may be used, weakened lines may only partially extend about the periphery of the various corners of the sheet/container, and/or weakened lines may extend about such corners in different shapes.

In addition, as best seen in FIG. 2, because some of the bottom panels overlap with one another, it may be preferably to position the weakened lines on the bottom panels so that they overlap with the corresponding weakened lines on an overlapping bottom panel. However, because various different configurations of sheets may be used, in embodiments in which the bottom wall of the container is not defined by overlapping panels, there may only be three sets of weakened lines defining each corner. Thus, once folded into a container, as shown in FIG. 2, such weakened lines may extend about each of the various corners in a triangular shape.

Figure 3:
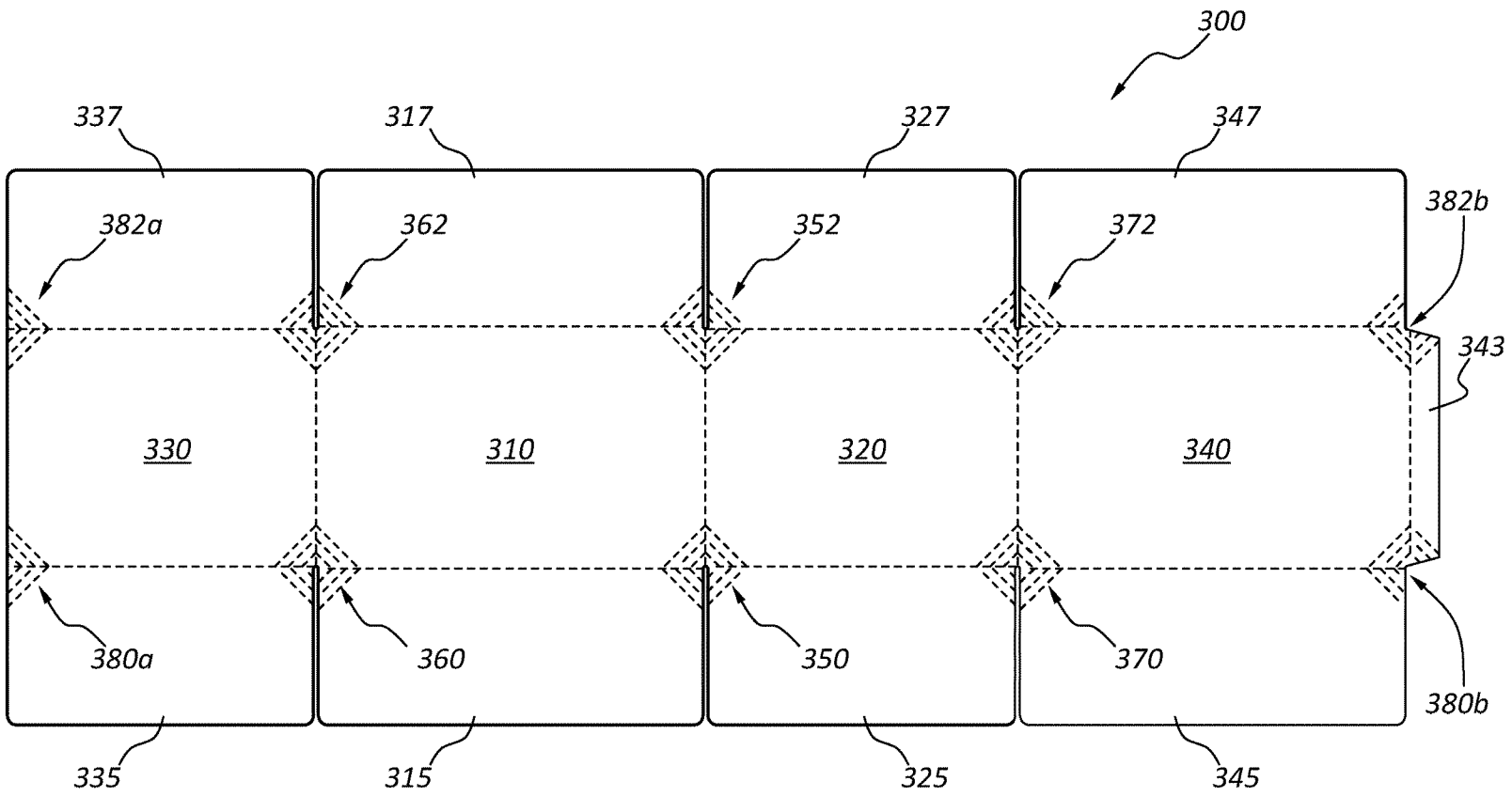
FIG. 3 is a top plan view of a sheet configured for folding into a container according to other embodiments.

FIG. 3 depicts an alternative embodiment of a sheet 300 that, once again, comprises a substantially planar sheet that may be folded into a three-dimensional container. Again, in some embodiments, sheet 300 may comprise a corrugated plastic, such as a plastic made up of corrugated flutes.

Sheet 300 comprises a plurality of panels configured to be folded with respect to one another during a folding/assembly process. More particularly, sheet 300 comprises a first panel 310 that, when folded/assembled, will define a side wall to a container, a second panel 320 configured to serve as an adjacent side wall of the container, a third panel 330 configured to serve as another side wall of the container, and a fourth panel 340 configured to serve as another side wall of the container.

Sheet 300 further comprises additional panels 315, 325, 335, and 345, each of which is configured to define a portion of a bottom wall of the container. In the depicted embodiment, some of the bottom panels may be configured to overlap with one another. In addition, unlike sheet 100, sheet 300 comprises various panels that define a lid or top wall of the container. Such panels therefore may be referred to herein as "top panels." More particularly, top panel 317 extends adjacent to side panel 310, top panel 327 extends adjacent to side panel 320, top panel 337 extends adjacent to side panel 330, and top panel 347 extends adjacent to side panel 340.

Various fold lines extend between the adjacent panels. For example, with respect to side panel 310, a fold line extends between side panel 310 and adjacent side panel 320. Similarly, another fold line extends between side panel 310 and bottom panel 315. And another fold line extends between side panel 310 and top panel 317. Also, like sheet 100, sheet 300 comprises a flap 343 that is configured to facilitate coupling between opposite ends of sheet 300.

Each of the various corner regions between adjacent side and bottom panels comprises a weakened region or crumple zone defined by a plurality of weakened lines. Each of these weakened regions is preferably configured to deform and absorb drop forces resulting from the container being dropped to reduce the possibility of the drop forces tearing the resulting container. In addition, each of the various corner regions between adjacent side and top panels also comprises a weakened region or crumple zone defined by a plurality of weakened lines. Each of these weakened regions is preferably also configured to deform and absorb drop forces resulting from the container being dropped to reduce the possibility of the drop forces tearing the resulting container. Thus, the container formed by sheet 300 may be configured to prevent or at least inhibit tearing of the container along the corners when dropped in any configuration. Embodiments comprising crumple zones along the upper corners may also be useful in connection with stackable containers so as to absorb forces associated with containers being abruptly stacked on top of one another.

More particularly, weakened region 350 is positioned at the corner between side panels 310 and 320, and bottom panels 315 and 325. Similarly, weakened region 360 is positioned at the corner between side panels 310 and 330, and bottom panels 315 and 335, and weakened region 370 is positioned at the corner between side panels 320 and 340, and bottom panels 325 and 345. An additional weakened region 380 defined by partial weakened regions **380*a* and 380*b* is partially defined at opposite ends of sheet 300. More particularly, partial weakened region 380*a* is defined between side panel 330 and bottom panel 335, and partial weakened region 380*b* is defined between side panel 340 and bottom panel 345. In some embodiments, part of the weakened region 380 may be formed on flap 343, as shown in FIG. 3**.

Similar weakened regions are formed along the top corners of sheet 300. Thus, weakened region 352 is positioned at the corner between side panels 310 and 320, and top panels 317 and 327, weakened region 362 is positioned at the corner between side panels 310 and 330, and top panels 317 and 337, and weakened region 372 is positioned at the corner between side panels 320 and 340, and top panels 327 and 347. An additional weakened region 382 defined by partial weakened regions **382*a* and 382*b* is partially defined at opposite ends of sheet 300. Again, in some embodiments, part of weakened region 382 may be positioned on a flap, such as flap 343**, if desired.

It will be understood by those having skill in the art that changes may be made to the details of the above-described embodiments without departing from the underlying principles presented herein. In addition, any suitable combination of various embodiments, or the features thereof, is contemplated.

Any methods disclosed herein may comprise one or more steps or actions for performing the described method. The method steps and/or actions may be interchanged with one another. In other words, unless a specific order of steps or actions is required for proper operation of the embodiment and/or implementation, the order and/or use of specific steps and/or actions may be modified.

Throughout this specification, any reference to "one embodiment," "an embodiment," or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, inventive aspects lie in a combination of fewer than all features of any single foregoing disclosed embodiment.

Those having skill in the art will therefore appreciate that many changes may be made to the details of the above-described embodiments without departing from the underlying principles of the invention. The scope of the present invention should, therefore, be determined only by the following claims.

The invention claimed is:

1. A sheet for folding into a container, comprising:

a first side panel;

a second side panel positioned adjacent to the first side panel;

a third side panel positioned adjacent to the first side panel opposite from the second side panel;

a first bottom panel positioned adjacent to the first side panel and configured to be folded with respect to the first side panel during a folding process for folding the sheet into a three-dimensional container so as to at least partially define a bottom wall of the container;

a first fold line extending between the first side panel and the first bottom panel;

a first plurality of weakened lines positioned on the first side panel and extending at an acute angle between the first fold line and the second side panel;

a second plurality of weakened lines positioned on the first side panel opposite from the first plurality of weakened lines and extending at an acute angle between the first fold line and the third side panel;

a third plurality of weakened lines positioned on the first bottom panel and extending at an acute angle between the first fold line and a first peripheral edge of the first bottom panel; and a fourth plurality of weakened lines positioned on the first bottom panel opposite from the third plurality of weakened lines and extending at an acute angle between the first fold line and a second peripheral edge of the first bottom panel opposite from the first peripheral edge.

2. The sheet of claim 1, further comprising:

a second bottom panel positioned adjacent to the second side panel;

a third bottom panel positioned adjacent to the third side panel;

a second fold line extending between the second side panel and the second bottom panel;

a third fold line extending between the third side panel and the third bottom panel;

a fifth plurality of weakened lines positioned on the second side panel and extending at an acute angle between the second fold line and the first side panel;

a sixth plurality of weakened lines positioned on the second bottom panel and extending at an acute angle between the second fold line and the first peripheral edge;

a seventh plurality of weakened lines positioned on the third side panel and extending at an acute angle between the third fold line and the first side panel; and an eighth plurality of weakened lines positioned on the third bottom panel and extending between the third fold line and the second peripheral edge.

3. The sheet of claim 2, wherein the first plurality of weakened lines at least substantially aligns with the fifth plurality of weakened lines, wherein the fifth plurality of weakened lines at least substantially aligns with the sixth plurality of weakened lines, wherein the sixth plurality of weakened lines at least substantially aligns with the third plurality of weakened lines, and wherein the third plurality of weakened lines at least substantially aligns with the first plurality of weakened lines.

4. The sheet of claim 3, wherein the first, third, fifth, and sixth plurality of weakened lines circumscribe a corner of the sheet defined by the first side panel, the second side panel, the first bottom panel, and the second bottom panel.

5. The sheet of claim 4, wherein the first, third, fifth, and sixth plurality of weakened lines together define a rectangular shape circumscribing the corner of the sheet.

6. The sheet of claim 5, wherein the rectangular shape comprises a square.

7. The sheet of claim 1, wherein the weakened lines comprise creases formed in the sheet.

8. A container, comprising:

a bottom wall; and a plurality of side walls, wherein each of the plurality of side walls is positioned adjacent to the bottom wall so as to define four bottom corners, wherein at least one of the four bottom corners comprises a weakened region comprising a plurality of weakened lines at least substantially encircling the at least one of the four bottom corners along the bottom wall and along two adjacent side walls, and wherein the weakened region is configured to deform and absorb drop forces resulting from the container being dropped to reduce the possibility of the drop forces tearing the container.

9. The container of claim 8, wherein the weakened lines comprise creases.

10. The container of claim 8, wherein the weakened lines are positioned to extend at least substantially parallel to each other.

11. The container of claim 10, wherein the weakened lines are spaced apart from each other by a distance of between about 0.5 inches and about 0.8 inches.

12. The container of claim 8, wherein the weakened lines extend from adjacent edges of the at least one of the four bottom corners at an acute angle ranging from between about 25 degrees and about 65 degrees.

13. The container of claim 12, wherein the weakened lines extend from adjacent edges of the at least one of the four bottom corners at an angle of about 45 degrees.

14. The container of claim 8, wherein each of the four bottom corners comprises a weakened region comprising a plurality of weakened lines encircling each bottom corner along the bottom wall and along two adjacent side walls such that each of the weakened regions is configured to deform and absorb drop forces resulting from the container being dropped to reduce the possibility of the drop forces tearing the container.

15. The container of claim 14, further comprising:

a top wall, wherein each of the plurality of side walls is positioned adjacent to the top wall so as to define four top corners, wherein each of the four top corners comprises a weakened region comprising a plurality of weakened lines encircling the at least one of the four top corners along the top wall and along two adjacent side walls, and wherein each of the weakened regions is configured to deform and absorb drop forces resulting from the container being dropped to reduce the possibility of the drop forces tearing the container.

16. A container, comprising:

a bottom wall;

a first bottom wall corner defined in part by the bottom wall; and a first weakened line circumscribing the first bottom wall corner without touching the first bottom wall corner, wherein the first weakened line is configured to deform and absorb drop forces resulting from the container being dropped to reduce the possibility of the drop forces tearing the container.

17. The container of claim 16, further comprising:

a second bottom wall corner defined in part by the bottom wall;

a second weakened line circumscribing the second bottom wall corner;

a third bottom wall corner defined in part by the bottom wall;

a third weakened line circumscribing the third bottom wall corner;

a fourth bottom wall corner defined in part by the bottom wall; and a fourth weakened line circumscribing the fourth bottom wall corner.

18. The container of claim 16, further comprising a second weakened line circumscribing the first bottom wall corner.

19. The container of claim 18, wherein the second weakened line is at least substantially parallel to the first weakened line, and wherein the second weakened line is spaced from the first weakened line by a distance of between about 0.5 inches and about 0.8 inches.

20. The container of claim 16, wherein the first weakened line extends from adjacent edges of the first bottom wall corner at acute angles ranging from between about 25 degrees and about 65 degrees.

* * * * *